US010049847B2

(12) United States Patent
Lee et al.

(10) Patent No.: US 10,049,847 B2
(45) Date of Patent: Aug. 14, 2018

(54) ELECTRON EMITTING DEVICE USING GRAPHITE ADHESIVE MATERIAL AND MANUFACTURING METHOD FOR THE SAME

(71) Applicant: Korea University Research and Business Foundation, Seoul (KR)

(72) Inventors: Cheol Jin Lee, Seoul (KR); Dong Hoon Shin, Seoul (KR); Ki Nam Yun, Gyeonggi-do (KR); Yu Ning Sun, Seoul (KR)

(73) Assignee: Korea University Research and Business Foundation, Seoul (KR)

( * ) Notice: Subject to any disclaimer, the term of this patent is extended or adjusted under 35 U.S.C. 154(b) by 0 days.

(21) Appl. No.: 15/700,297

(22) Filed: Sep. 11, 2017

(65) Prior Publication Data

US 2018/0012721 A1 Jan. 11, 2018

Related U.S. Application Data

(63) Continuation of application No. PCT/KR2016/002340, filed on Mar. 9, 2016.

(51) Int. Cl.

| | |
|---|---|
| ***H01J 1/05*** | (2006.01) |
| ***H01J 9/02*** | (2006.01) |
| ***H01J 1/304*** | (2006.01) |
| ***H01J 29/04*** | (2006.01) |

(52) U.S. Cl.

CPC ..... *H01J 9/025* (2013.01); *H01J 1/304* (2013.01); *H01J 29/04* (2013.01); *H01J 2201/30403* (2013.01)

(58) Field of Classification Search

USPC ..... 313/311, 309, 336, 351, 495

See application file for complete search history.

(56) References Cited

FOREIGN PATENT DOCUMENTS

| | | | |
|---|---|---|---|
| KR | 1020060098700 | A | 9/2006 |
| KR | 1020100029538 | A | 3/2010 |
| KR | 1020100107837 | A | 10/2010 |
| KR | 101026867 | B1 | 4/2011 |
| KR | 1020110118070 | A | 10/2011 |
| KR | 1020130115467 | A | 10/2013 |

*Primary Examiner* — Vip Patel

(74) *Attorney, Agent, or Firm* — Fox Rothschild LLP

(57) ABSTRACT

The present disclosure relates to a manufacturing method for an electron emitting device using a graphite adhesive material. A method of preparing paste for forming a cathode of an electron emitting device includes: mixing and dispersing a nanomaterial for electron emission and a graphite filler in a solvent; drying a mixed solution in which the nanomaterial and the graphite filler are mixed; and preparing paste by mixing a graphite binder with the dried mixture.

14 Claims, 5 Drawing Sheets

ELECTRON EMITTING DEVICE USING GRAPHITE ADHESIVE MATERIAL AND MANUFACTURING METHOD FOR THE SAME

TECHNICAL FIELD

The present disclosure relates to an electron emitting device using a graphite adhesive material composed of graphite filler and binder and a manufacturing method for the same.

BACKGROUND

Electron emission refers to the release of electrons from a surface of an anode due to a lowered energy barrier in a vacuum when a strong electric field is applied between an anode and the cathode in a vacuum. Examples using the electron emission may include an electron emitting display, an X-ray emitting device, a LCD backlight, and the like.

In general, examples of a manufacturing method for an electron emitting device include a direct deposition method of vertically depositing an electron emitting material on a cathode substrate via chemical vapor deposition (CVD) and a paste processing method of preparing a nanomaterial in the form of paste and coating the nanomaterial on a cathode substrate.

However, in a manufacturing process for an electron emitting device according to the direct deposition method and the paste processing method, the adhesion between a substrate and an electron emitting nanomaterial is low, which may cause deterioration in stability of electron emission and thus cause non-uniform electron emission.

Conventionally, in order to solve this problem, a method of manufacturing an emitter by forming an adhesion enhancing material layer on an electrode substrate or a method of adding a filler material for enhancing adhesion to paste has been widely used.

Filler materials which have been conventionally used in the paste process can be roughly classified into an organic filler, an insulating filler, and a metallic filler depending on the properties of a material. For example, acryl, glass, asbestos, clay, $SiO_2$, $Al_2O_3$, and the like may be used as fillers. However, these fillers are very vulnerable in a high-temperature environment. Therefore, in a high-temperature environment for electron emission, the organic filler and the insulating filler may undergo outgassing and the metallic material may undergo melting of metal.

In this regard, Korean Patent Laid-open Publication No. 10-2006-0098700 (entitled "Method of vertical growth and application with carbon nanotubes pastes") discloses a technology of manufacturing a device in which carbon nanotubes in the form of paste are vertically grown on a substrate to improve the properties of electron emission.

DISCLOSURE OF THE INVENTION

Problems to be Solved by the Invention

The present disclosure is conceived to solve the above-described problem of the conventional technology, and some exemplary embodiments of the present disclosure provide a manufacturing method for an electron emitting device in which the adhesion and electric conductivity between a substrate and an electron emitting nanomaterial is improved by using a graphite adhesive material.

However, problems to be solved by the present disclosure are not limited to the above-described problems. There may be other problems to be solved by the present disclosure.

Means for Solving the Problems

As a technical means for solving the above-described problem, a method of preparing paste for forming a cathode of an electron emitting device according to an exemplary embodiment of the present disclosure includes: mixing and dispersing a nanomaterial for electron emission and a graphite filler in a solvent; drying a mixed solution in which the nanomaterial and the graphite filler are mixed; and preparing paste by mixing a graphite binder with the dried mixture.

Further, a method of manufacturing a cathode of an electron emitting device according to an exemplary embodiment of the present disclosure includes: mixing and dispersing a nanomaterial for electron emission and a graphite filler in a solvent; drying a mixed solution in which the nanomaterial and the graphite filler are mixed; preparing paste by mixing a graphite binder with the dried mixture; and forming a thin film by coating the paste on a cathode.

Furthermore, an electron emitting device according to an exemplary embodiment of the present disclosure includes: a substrate; and a thin film formed of paste including a nanomaterial for electron emission and a graphite adhesive material including graphite filler and binder.

Effects of the Invention

According to the above-described means for solving the problem, the method of preparing paste and the method of forming a thin film can make it easy to manufacture an electron emitting device which is enhanced in adhesion to a metallic substrate (cathode substrate).

Further, the use of the graphite adhesive material (graphite filler and graphite binder) which is a conductive material can improve the electric conductivity between the nanomaterial for electron emission and the cathode substrate.

BEST MODE FOR CARRYING OUT THE INVENTION

Figure 1:
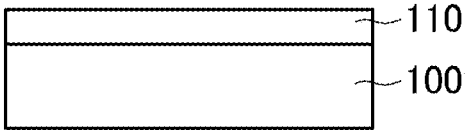
FIG. 1 illustrates a part of an electron emitting device in accordance with an exemplary embodiment of the present disclosure.

Hereinafter, embodiments of the present disclosure will be described in detail with reference to the accompanying drawings so that the present disclosure may be readily implemented by those skilled in the art. However, it is to be noted that the present disclosure is not limited to the embodiments but can be embodied in various other ways. In drawings, parts irrelevant to the description are omitted for the simplicity of explanation, and like reference numerals denote like parts through the whole document.

Through the whole document, the term "connected to" or "coupled to" that is used to designate a connection or coupling of one element to another element includes both a case that an element is "directly connected or coupled to" another element and a case that an element is "electronically connected or coupled to" another element via still another element. Further, the term "comprises or includes" and/or "comprising or including" used in the document means that one or more other components, steps, operation and/or existence or addition of elements are not excluded in addition to the described components, steps, operation and/or elements unless context dictates otherwise. Through the whole document, the term "step of" does not mean "step for".

Through the whole document, the term "on" that is used to designate a position of one element with respect to another element includes both a case that the one element is adjacent to the another element and a case that any other element exists between these two elements.

FIG. 1 illustrates a part of an electron emitting device in accordance with an exemplary embodiment of the present disclosure.

The electron emitting device in accordance with an exemplary embodiment of the present disclosure may include a substrate 100 and a thin film 110, and may further include other components if necessary.

The substrate 100 is a substrate generally used for semiconductor device and may be formed using glass, quartz, silicon (Si), germanium (Ge), or the like. Otherwise, a substrate coated with a metallic electrode such as gold (Au), silver (Ag), copper (Cu), aluminum (Al), a nickel alloy (Inconel), stainless steel (SUS304), kovar, or the like or a transparent electrode such as indium tin oxide (ITO), graphene, or the like may be used.

The thin film 110 may be prepared and formed using paste including a nanomaterial for electron emission and a graphite adhesive material composed of a graphite filler and a graphite binder.

Specifically, the thin film 110 may be formed by stacking a nanomaterial for electron emission such as a carbon-based material, e.g., carbon nanotube (CNT) and graphene, a boron-nitride (BN)-based material, molybdenum disulphide ($MoS_2$), or nanowire, but may not be limited thereto. Herein, the nanomaterial for electron emission may be slantly formed at a predetermined angle or vertically formed at an angle of 90 degrees on an upper surface of the substrate 100.

According to the present disclosure, graphite nanoparticles are used as a filler. The graphite filler may be formed as ball-shaped graphite nanoparticles having a size of from about 200 nm to about 500 nm or a graphite nanoplate and may have excellent electric conductivity. The graphite filler is different from typical graphite having a size of several tens to several micrometers. Further, the graphite filler does not undergo outgassing or material decomposition even at a high temperature of 3000° C. or more and does not affect the characteristics of an emitter during electron emission. Further, the graphite filler is compressed into the nanomaterial for electron emission and thus electrically connects the substrate 100 and the nanomaterial for electron emission and also functions to suppress clotting of nanomaterials for electron emission and enable the nanomaterials for electron emission to be well dispersed in the paste. Also, the graphite adhesive material functions to suppress separation of the nanomaterial for electron emission from the substrate 100 during electron emission and thus can enhance the adhesion between the nanomaterial for electron emission and the substrate 100 and improve the stability of the electron emitting device.

Figure 2:
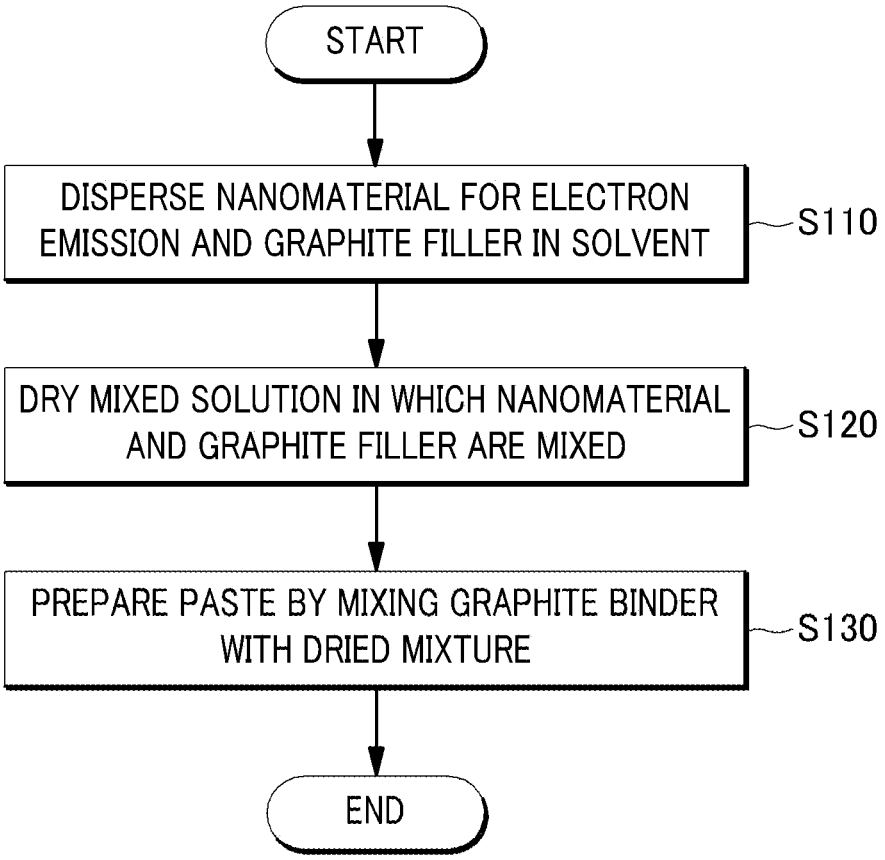
FIG. 2 is a flowchart provided to explain each process of a method of preparing paste for forming a cathode of an electron emitting device in accordance with an exemplary embodiment of the present disclosure.

Hereinafter, a method of preparing paste for forming a cathode of an electron emitting device in accordance with an exemplary embodiment of the present disclosure will be described in detail with reference to FIG. 2. FIG. 2 is a flowchart provided to explain each process of the method of preparing paste for forming a cathode of an electron emitting device in accordance with an exemplary embodiment of the present disclosure.

A method of preparing paste for forming a cathode of an electron emitting device according to an exemplary embodiment of the present disclosure may include: mixing and dispersing a nanomaterial for electron emission and a graphite filler in a solvent (S110); drying a mixed solution in which the nanomaterial and the graphite filler are mixed (S120); and preparing paste by mixing a graphite binder with the dried mixture (S130).

Firstly, a nanomaterial for electron emission and a graphite filler are mixed in a solvent and sonication is performed thereto (S110). In an exemplary embodiment of the present disclosure, the graphite filler is formed as graphite nanoparticles with a purity of 99% and has a coefficient of thermal expansion of 4.1×10-6/° F., a thermal conductivity of 60 BTU*in/Hr*° F.*Ft2, a compression strength of 3000 psi, and a flexural strength of 1500 psi, but may not be limited thereto. In this case, according to an exemplary embodiment, the solvent may be an organic solvent such as ethanol, isopropyl alcohol (IPA), dichlorobenzene (1,2-dichlorobenzene) (DCB), dicholoroethane (1,2-dicholoroethane) (DCE), and N-methylpyrrolidone (1-methyl-2-pyrrolidone) (NMP). According to another exemplary embodiment, the solvent may be an aqueous solution in which a surfactant component such as sodium dodecyl sulfate (SDS) and sodium dodecyl benzene sulfonate (SDBS) is mixed.

The nanomaterial and the graphite filler in the solvent may aggregate or agglomerate together and may form an aggregate having a thickness of several hundreds nm to several μm. In accordance with an exemplary embodiment of the present disclosure, the aggregate nanomaterial and graphite filler can be scattered or dispersed at a certain distance from each other through sonication.

Figure 3:
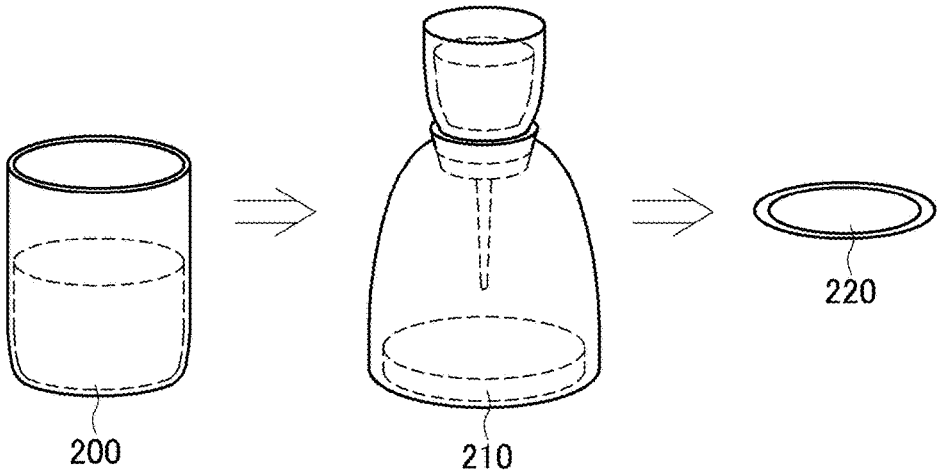
FIG. 3 illustrates an example of a nanomaterial for electron emission and a graphite adhesive material which is dried by a vacuum filtration method and formed as a thin film according to an exemplary embodiment of the present disclosure.

FIG. 3 illustrates an example of a nanomaterial for electron emission and a graphite filler which is dried by a vacuum filtration method and formed as a thin film according to an exemplary embodiment of the present disclosure.

In the process of drying a mixed solution in which the nanomaterial and the graphite filler are mixed (S120), a mixed solution 200 in which the nanomaterial and the graphite filler are mixed may be dried while passing through a vacuum filtration device 210. Therefore, as illustrated in FIG. 3, the solvent may be removed by the vacuum filtration device 210 and the nanomaterial and the graphite filler remaining on a filter paper may be formed as a thin film 220.

Then, in the process of preparing paste by mixing a graphite binder with the dried mixture (S130), the graphite binder which is an adhesive solution having viscosity may be added to the mixture 220 in the form of a thin film in which the nanomaterial and the graphite filler are mixed, and then mixed with each other through a ball milling process to prepare paste.

Figure 4:
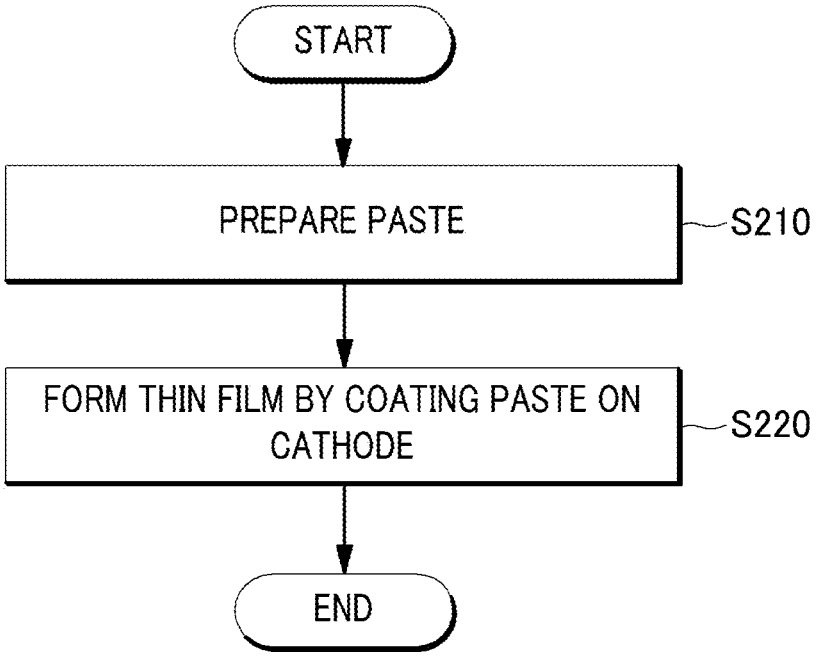
FIG. 4 is a flowchart provided to explain a method of manufacturing a cathode of an electron emitting device in accordance with an exemplary embodiment of the present disclosure in detail.

FIG. 4 is a flowchart provided to explain a method of manufacturing a cathode of an electron emitting device in accordance with an exemplary embodiment of the present disclosure in detail.

Referring to FIG. 4, a method of manufacturing a cathode of an electron emitting device suggested by the present disclosure may include: preparing paste (S210); and forming a thin film by coating the paste on a cathode (S220).

Herein, the process of preparing paste (S210) is the same as the above-described process of preparing paste for forming a cathode of an electron emitting device. Therefore, detailed description thereof will be omitted.

Then, the paste may be coated on the cathode of the electron emitting device by performing any one of screen printing, dip coating, stamping, and spin coating, and, thus, a thin film can be formed (S220).

Although not illustrated in the drawing, the method of manufacturing a cathode of an electron emitting device according to an exemplary embodiment of the present disclosure may further include vertically aligning the nanomaterial for electron emission on a surface of a cathode substrate by performing any one of taping or rolling or sequentially performing the two processes on a surface of the thin film after the process of forming the thin film by coating the paste on the cathode.

Specifically, a surface of a metallic substrate on which the nanomaterial is formed may be uniformly pressed with a rubber roller. Otherwise, a surface of a metallic substrate on which the nanomaterial for electron emission is formed may be taped with an adhesive tape and then, a surface of the nanomaterial may be uniformly pressed with a roller. Thus, the nanomaterial weakly adhering to the metallic substrate can be removed and the nanomaterial can be vertically aligned on the surface of the cathode substrate. Alternatively, a surface of the nanomaterial formed on a metallic substrate may be uniformly ground by sandpaper grinding or a combination of the above-described methods may be applied. Therefore, unnecessary nanomaterial having poor adhesion can be removed from the metallic substrate and the nanomaterial for electron emission can be vertically aligned on the surface of the cathode substrate with effect. Herein, the vertically aligned nanomaterials for electron emission can more effectively concentrate electrons than nanomaterials horizontally or slantly formed on the cathode substrate and thus may have the improved properties of electron emission.

Figure 5:
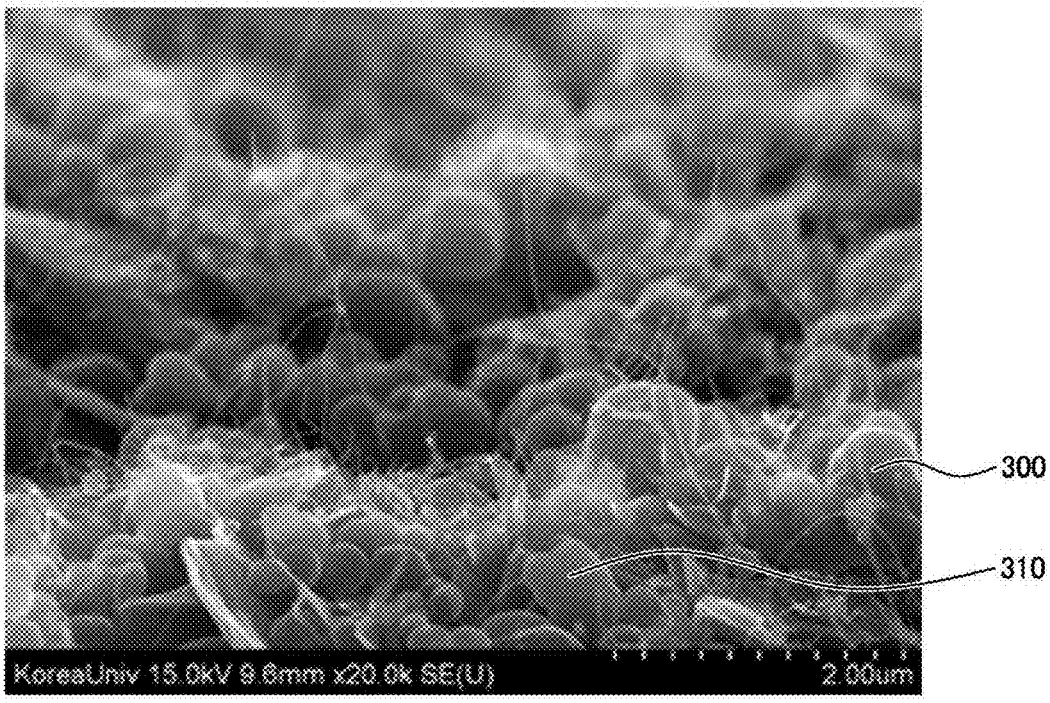
FIG. 5 is a scanning electron microscope image of a thin film formed using paste prepared according to an exemplary embodiment of the present disclosure.

FIG. 5 is a scanning electron microscope image of a thin film for electron emission formed using paste prepared according to an exemplary embodiment of the present disclosure.

Specifically, FIG. 5 shows a scanning electron microscope (SEM) image of a cathode of an electron emitting device manufactured using a carbon nanotube as an example of a nanomaterial for electron emission and paste prepared by the above-described method.

Referring to FIG. 5, it can be seen that carbon nanotubes 300 in the form of wire and graphite fillers 310 in the form of particle are present in the paste. Herein, it can be seen that the carbon nanotubes 300 do not aggregate together and are uniformly scattered or dispersed at a certain distance from each other in the paste through sonication, and the graphite nanoparticles function as the fillers 310 to fill a space between the carbon nanotubes 300.

The electron emitting device manufactured according to an exemplary embodiment of the present disclosure uses a graphite adhesive material (graphite filler and graphite binder) which is a conductive material and thus can improve the electric conductivity between the nanomaterial for electron emission and the cathode substrate. Therefore, the electron emitting device according to an exemplary embodiment of the present disclosure has a very high emission current density as compared with the conventional carbon nanotube electron emission devices manufactured using an organic filler, an insulating filler, or a metallic filler.

Further, since the graphite adhesive material has resistance to high temperature, a high-temperature heat treatment can be applied after the paste is prepared. Thus, it is possible to effectively remove a remaining organic material of the electron emitting device. If the high-temperature heat treatment is applied, the existing materials used as fillers may be melted or deformed and thus may cause performance degradation or a defect of the electron emitting device. In the present disclosure, the high-temperature heat treatment may be performed after the thin film is formed.

The above description of the present disclosure is provided for the purpose of illustration, and it would be understood by those skilled in the art that various changes and modifications may be made without changing technical conception and essential features of the present disclosure. Thus, it is clear that the above-described embodiments are illustrative in all aspects and do not limit the present disclosure. For example, each component described to be of a single type can be implemented in a distributed manner. Likewise, components described to be distributed can be implemented in a combined manner.

The scope of the present disclosure is defined by the following claims rather than by the detailed description of the embodiment. It shall be understood that all modifications and embodiments conceived from the meaning and scope of the claims and their equivalents are included in the scope of the present disclosure.

| EXPLANATION OF REFERENCE NUMERALS | |
|---|---|
| 100: Substrate | 110: Thin film |
| 200: Mixed solution | 210: Vacuum filtration device |
| 220: Mixture thin film | |
| 300: Carbon nanotube | |
| 310: Graphite filler | |

We claim:

1. A cathode of an electron emitting device comprising:
a cathode substrate; and
a thin film deposited on the cathode substrate;
wherein the thin film formed of paste including a nanomaterial for electron emission and a graphite adhesive material; and
wherein the graphite adhesive material composed of a graphite filler and a graphite binder.

2. The cathode of the electron emitting device of claim 1, wherein the nanomaterial for electron emission is dispersed by the graphite filler.

3. The cathode of the electron emitting device of claim 1, wherein the graphite binder bonds the nanomaterial for electron emission and the graphite filler to each other.

4. A method of preparing paste for forming a cathode of an electron emitting device, comprising:
mixing and dispersing a nanomaterial for electron emission and a graphite filler in a solvent;
drying the mixed and dispersed solution in which the nanomaterial and the graphite filler are mixed in order to form a dried mixture; and
preparing paste by mixing a graphite binder with the dried mixture.

5. The method of preparing paste of claim 4, wherein the nanomaterial for electron emission is any one of carbon nanotube (CNT), graphene, boron-nitride (BN), molybdenum disulphide ($MoS_2$) and nanowire.

6. The method of preparing paste of claim 4, wherein the solvent is any one organic solvent of ethanol, isopropyl alcohol (WA), dichlorobenzene (1,2-dichlorobenzene) (DCB), dicholoroethane (1,2-dicholoroethane) (DCE), and N-methylpyrrolidone (1-methyl-2-pyrrolidone) (NMP).

7. The method of preparing paste of claim 4, wherein the solvent is an aqueous solution in which any one of sodium dodecyl sulfate (SDS) and sodium dodecyl benzene sulfonate (SDBS) is mixed.

8. The method of preparing paste of claim 4, wherein the dispersing includes performing sonication.

9. The method of preparing paste of claim 4, wherein the preparing of paste includes mixing the dried mixture and the binder through a ball milling process.

10. A method of manufacturing a cathode of an electron emitting device, comprising:

mixing and dispersing a nanomaterial for electron emission and a graphite filler in a solvent;

drying the mixed and dispersed solution in which the nanomaterial and the graphite filler are mixed in order to form a dried mixture;

preparing paste by mixing a graphite binder with the dried mixture; and forming a thin film by coating the paste on a cathode.

11. The method of manufacturing a cathode of an electron emitting device of claim 10, wherein the coating of the paste on a cathode includes performing any one of screen printing, dip coating, stamping, and spin coating.

12. The method of manufacturing a cathode of an electron emitting device of claim 10, further comprising:

after the forming of a thin film, performing a high-temperature heat treatment.

13. The method of manufacturing a cathode of an electron emitting device of claim 10, further comprising:

protruding or vertically aligning the nanomaterial for electron emission on a surface of a cathode substrate.

14. The method of manufacturing a cathode of an electron emitting device of claim 13, wherein the protruding or vertically aligning of the nanomaterial for electron emission on a surface of a cathode substrate includes performing a physical process of treating a surface of the nanomaterial formed on a metallic substrate by using at least any one of taping, rolling, and sandpaper grinding on a surface of the thin film.

* * * * *